US005161466A

United States Patent [19]

Burris

[11] Patent Number: 5,161,466

[45] Date of Patent: Nov. 10, 1992

[54] PALLET ASSEMBLY FOR OVER-ALL GARMENT PRINTING

[75] Inventor: Michael E. Burris, Concord, N.C.

[73] Assignee: Piedmont Screen Printers, Concord, N.C.

[21] Appl. No.: 735,857

[22] Filed: Jul. 25, 1991

[51] Int. Cl.[5] ..... B41F 15/18

[52] U.S. Cl. ..... 101/474; 101/126

[58] Field of Search ..... 101/474, 126, 115; 38/135

[56] References Cited

U.S. PATENT DOCUMENTS

| | | | |
|---|---|---|---|
| 1,443,316 | 1/1923 | Evans | 101/126 |
| 2,846,946 | 8/1958 | Schwarzberger | 101/115 |
| 3,244,093 | 4/1966 | Vasilantone . | |
| 4,287,826 | 9/1981 | Brabec | 101/126 X |
| 4,722,272 | 2/1988 | Caruccio et al. | 101/126 |
| 4,819,559 | 4/1989 | Szarka | 101/474 |
| 4,846,058 | 7/1989 | Farris | 101/123 |
| 4,875,268 | 10/1989 | Szarka | 29/283 |
| 4,896,597 | 1/1990 | Hayata et al. | 101/126 |
| 4,909,146 | 3/1990 | Szarka | 101/126 |
| 4,930,413 | 6/1990 | Jaffa | 101/126 |

*Primary Examiner*—Clifford D. Crowder
*Attorney, Agent, or Firm*—Richard E. Jenkins

[57] ABSTRACT

A pallet assembly for "over-all" garment printing on a multi-station printing machine where the pallet assembly comprises a planar pallet having a pallet support positioned beneath the pallet and hinge means serving to pivotably mount the top edge of the pallet to the top portion of the pallet support. The pallet support includes laterally outwardly extending sleeve support portions on opposing sides thereof, and securement means are provided for releaseably securing the pallet against the pallet support.

7 Claims, 4 Drawing Sheets

PALLET ASSEMBLY FOR OVER-ALL GARMENT PRINTING

TECHNICAL FIELD

This invention relates to pallet assemblies for printing on multi-station rotary printing machines. More particularly, this invention relates to an improved pallet assembly which provides for "over-all" printing on garments with a multi-station rotary printing machine.

BACKGROUND ART

As is well known to those in the garment printing art, there are a number of commercial multi-station rotary printing apparatus available for printing multiple color images on garments such as T-shirts. These multi-station rotary printing apparatus utilize a plurality of fixed pallets positioned radially around the vertical rotational axis for receiving a garment to be printed. The pallets with garments positioned thereon are rotated around the vertical axis of the rotary printing apparatus to individual print stations where selected print images are applied to the garment. With this type of multiple station printing apparatus, multiple color patterns utilizing up to eight (8) or more colors may be applied to the garment by "spot printing".

Historically, multiple station rotary printing apparatus have primarily been used for the aforesaid "spot-printing" of multiple color designs onto a garment which has been stretched over the pallet. This type of "spot-printing" of designs onto T-shirts is well known to anyone familiar with printed casual wear T-shirts such as those worn today by adults and children.

Although the prior art multi-station rotary printing apparatus works well for "spot-printing" of T-shirts and other similar garments, the multi-station rotary printing apparatus has not historically been capable of satisfactory multiple color printing of the entire surface (including the sleeves) of a T-shirt or similar garment due to shortcomings in the conventional pallet assembly. To some extent the shortcomings of conventional one-piece wooden pallets were overcome by the improved pallet assembly disclosed in U.S. Pat. No. 4,819,559 to Szarka. The Szarka patent discloses an improved pallet assembly for full surface (less the sleeves), two-sided printing of fabrics and garments on a rotary-type multi-station printing apparatus. The pallet assembly of Szarka comprises a flat bottom pallet support member which has the same general shape as the metal pallet positioned thereon except that it is somewhat wider so that printing can be accomplished to the side edges of the garment positioned on the pallet. The pallet is removably secured to the support structure at one end with a keeper pin and at the other end with a ball-and-socket hinge assembly so that the pallet may be removed from the support structure after printing of one side of the garment. The garment and pallet are then rotated and resecured to the support structure in order to permit the garment positioned on the pallet to be printed on the other side. The pallet assembly suffers from shortcomings both due to its complexity as well as the functional shortcoming of not providing for "over-all" printing of the entire surface of a T-shirt or similar garment since the pallet assembly will not allow for surface printing onto the sleeves of the garment.

DISCLOSURE OF THE INVENTION

In accordance with the present invention, applicant provides an improved pallet assembly designed specifically for "over-all" printing on a multi-station rotary printing apparatus. The pallet assembly comprises a planar pallet which is adapted for receiving a garment thereon for "over-all" printing of the entire surface thereof and defining a top edge, a bottom edge, and opposing side edges. A pallet support is positioned beneath the planar pallet and defines a top portion adjacent the top edge of the pallet and bottom portion adjacent the bottom edge of the pallet. The pallet support includes laterally outwardly extending support portions on opposing sides adjacent the bottom portion thereof for supporting the sleeves of a garment positioned on the pallet. Hinge means for pivotably mounting the pallet to the pallet support join the top edge of the pallet to the top portion of the pallet support. Finally, securement means are provided for releaseably securing the pallet against the pallet support during multi-station printing of a garment positioned on the pallet.

Accordingly, it is an object of the present invention to provide an improved pallet assembly which is adapted for use in "over-all" garment printing on multi-station rotary printing apparatus.

Another object of the present invention is to provide a pallet assembly which facilitates "over-all" multi-color printing of garments such as T-shirts as well as easy removal and replacement of the garment on the pallet for printing of the unprinted side thereof.

Still another object of the present invention is to provide a pallet assembly which can be used to replace conventional pallets on multi-station rotary printing apparatus so as to convert the apparatus from "spot-printing" capability to "over-all" printing capability with up to eight (8) or more colors in good registration.

BRIEF DESCRIPTION OF THE DRAWINGS

Some of the objects of the invention having been stated, other objects will become evident as the description proceeds, when taken in connection with accompanying drawings in which.

BEST MODE FOR CARRYING OUT THE INVENTION

Figure 1:
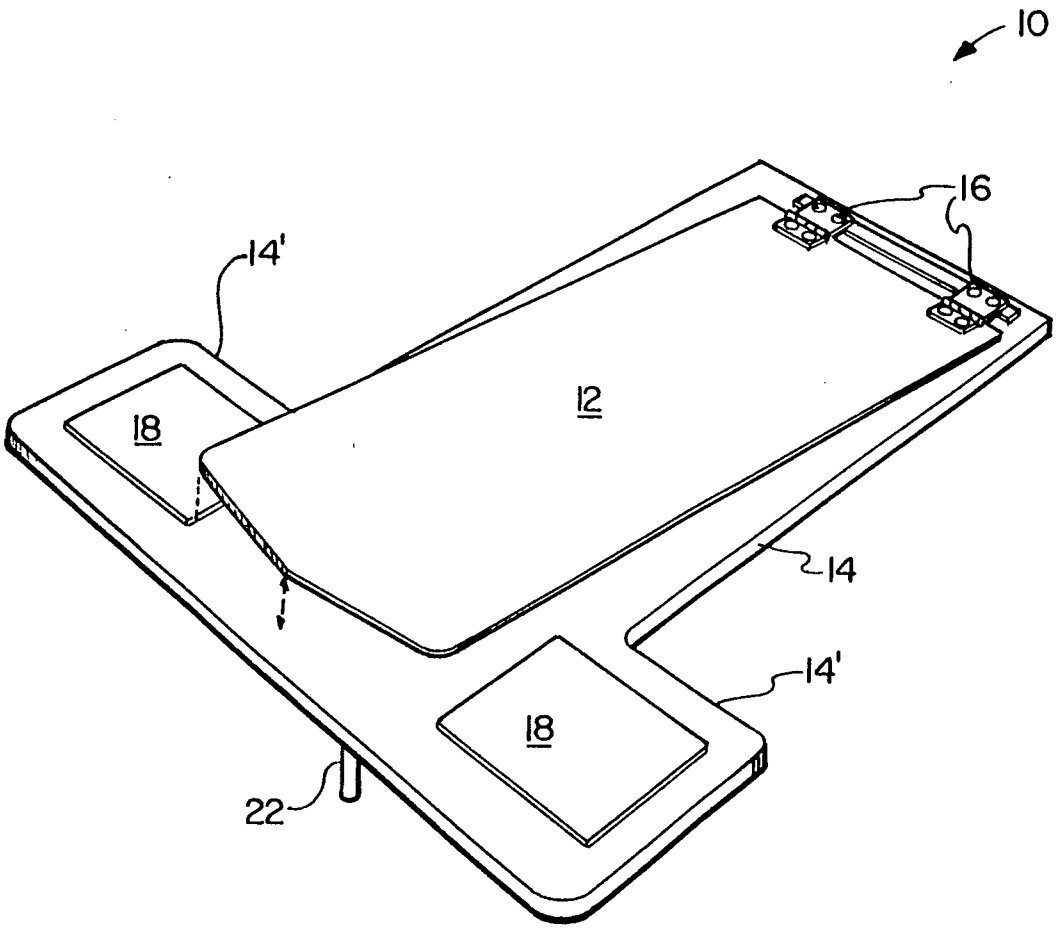
FIG. 1 is a perspective view of a pallet assembly in accordance with the present invention.

Referring now more specifically to the drawings, a preferred embodiment of an improved pallet assembly for "over-all" printing on a multi-station rotary printing apparatus according to the present invention is shown in FIGS. 1–6 and generally designated 10. Pallet assembly 10 comprises pallet 12 which is pivotably attached at the top end thereof to pallet support 14 by hinges 16.

Although other constructions are certainly possible and within the scope of the instant invention, most suitably pallet 12 is formed from an aluminum sheet (⅛ inch in thickness) and pallet support 14 is formed from wood. The size of pallet 12 will vary depending upon the size of the T-shirt or other garment which is being positioned thereon for printing, and most suitably pallet support 14 is slightly wider than the pallet 12 to facilitate printing of the garment.

Figure 3:
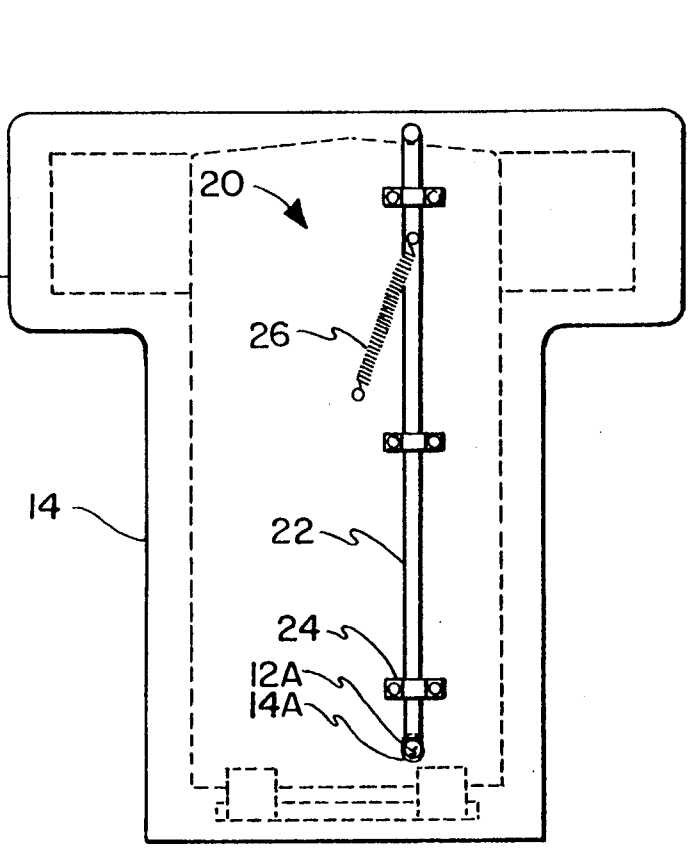
FIG. 3 is a bottom plan view of the pallet assembly of FIG. 1.
Figure 2:
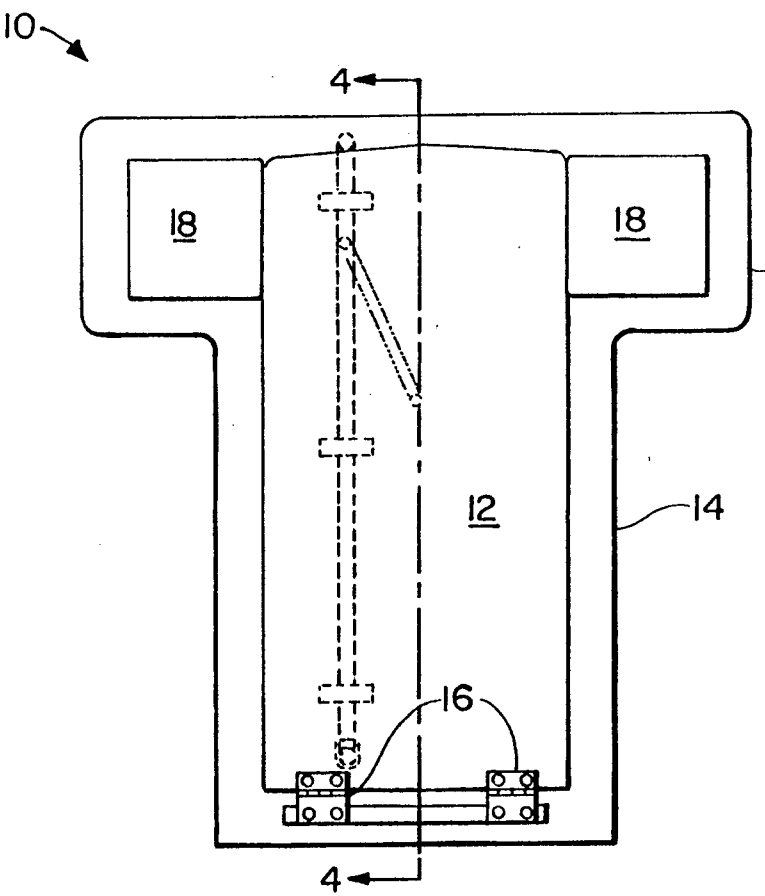
FIG. 2 is a top plan view of the pallet assembly of FIG. 1.
Figure 4:
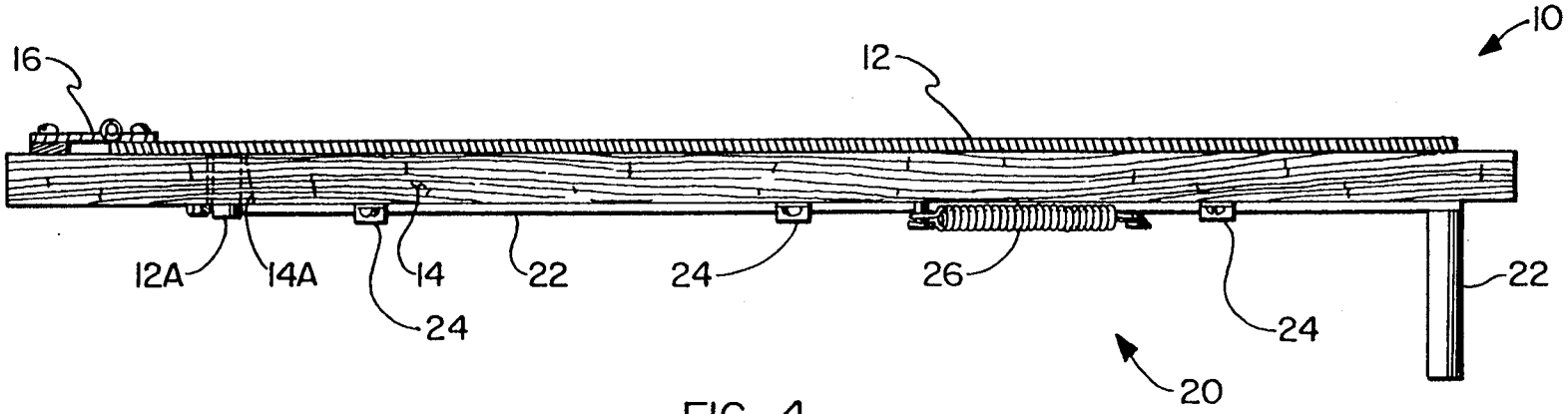
FIG. 4 is a vertical cross sectional view taken along the line 4—4 in FIG. 2 wherein the pallet is secured to the pallet support.

Pallet support 14 preferably includes two outwardly extending support arms 14' adjacent the bottom end thereof and remote from hinges 16 securing pallet 12 to pallet support 14 (although, alternatively, support arms 14' could extend along the entire length of each side of pallet support 14 so as to provide a generally rectangular shape to pallet support 14 as opposed to the preferred T-shape). Support arms 14' (which are best seen in FIGS. 1-3) each have a small sheet of rubber 18 affixed to the top surface thereof which substantially abuts a corresponding side edge of pallet 12 and is sufficiently thick so that the top surface thereof is substantially co-planar with the top surface of pallet 12 when it is resting on pallet support 14. Applicant has found a 3/16 inch thick rubber sheet to be particularly effective in the pallet assembly of the invention. As will be discussed in more detail below, rubber sheets 18 serve the very important purpose of providing a flat surface for the sleeves of a T-shirt or other similar type of garment positioned on pallet 12 to be laid upon for "over-all" printing of the entire garment (including the sleeves). As those familiar with the T-shirt printing art will be well aware, "over-all" printing has become a major fad and is presently preferred by many consumers to the well known "spot-printing" of multiple colored images upon the front and/or back of a T-shirt or similar type of garment. Although a matter of design choice, applicant has found that pallet support 14 is most suitably sized at about 44 inches×40 inches (replacing a conventional flat wood or aluminum fixed pallet sized about 28 inches×40 inches).

As best seen in FIGS. 2-5, a slide assembly 20 is provided beneath pallet support 14 for releaseably securing pallet 12 to pallet support 14 during the multi-station rotary printing process of a garment positioned on pallet assembly 10. As shown in FIGS. 2-5, the slide assembly 20 comprises a metal rod 22 having a handle at the outermost end thereof and which is slidably retained within a plurality of brackets 24 which are suitably secured to the bottom of pallet support 14. A coil spring 26 is affixed at one end to metal rod 22 and at the other end to pallet support 14 so as to normally urge metal rod 22 inwardly toward the upper end of pallet support 14. Pallet 12 includes an elongate finger or peg 12A (see particularly FIGS. 4 and 5) affixed to the underside thereof and depending downwardly therefrom so as to extend through an aperture 14A defined substantially therebeneath by pallet support 14. As can be appreciated with reference to FIGS. 4 and 5, peg 12A is sized so as to extend through aperture 14A and somewhat therebeyond when pallet 12 is lowered to rest upon pallet support 14. In this fashion, when pallet 12 is raised it will also withdraw peg 12A upwardly into aperture 14A of pallet support 14. When this occurs, metal rod 22 will be urged forwardly by spring 26 so as to traverse the bottom opening of aperture 14A. This serves to maintain pallet 12 in a raised position even when released by the operator of the multi-station printing apparatus to which pallet assembly 10 is secured since peg 12A will now rest upon metal rod 22 traversing aperture 14A. In order to lower pallet 12 against pallet support 14, the operator must pull the handle of rod 22 outwardly so as to remove the remote end of rod 22 from its position adjacent the bottom of aperture 14A (see FIG. 4). Peg 12A will then be released and allowed to pass through aperture 14A and pallet 12 will be allowed to pivot downwardly into surface contact with pallet support 14. The importance of slide assembly 20 will be better appreciated with reference to the operational description which is set forth hereinafter.

Figure 5:
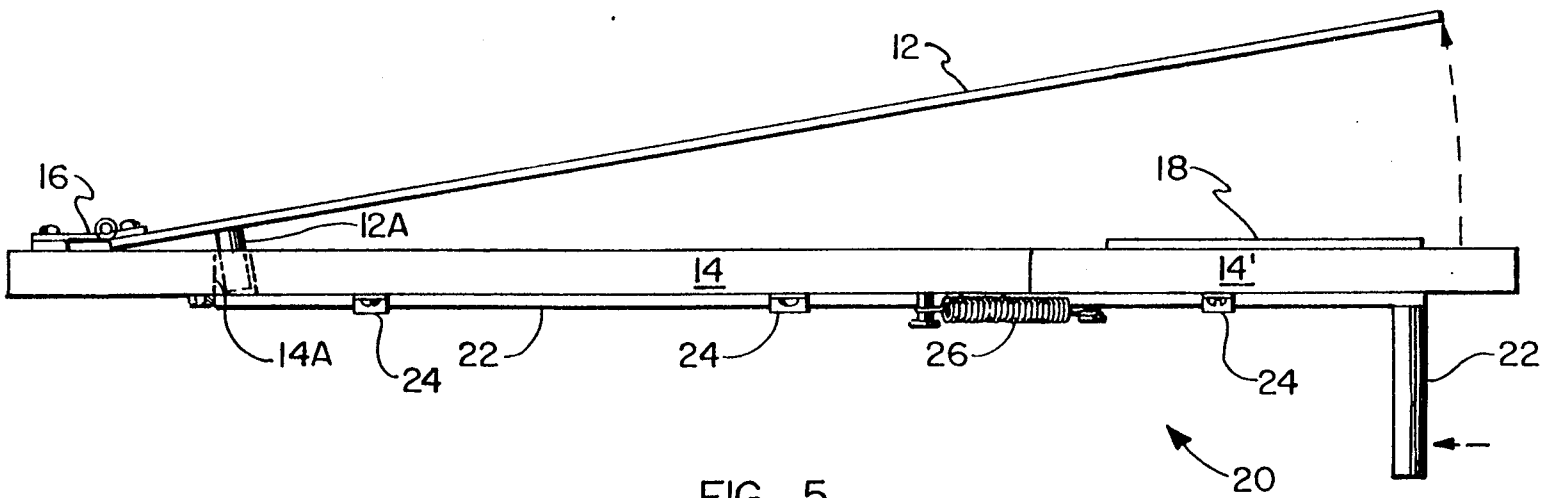
FIG. 5 is a side elevational view similar to FIG. 4 but wherein the pallet has been pivotably raised above the pallet support.
Figure 6:
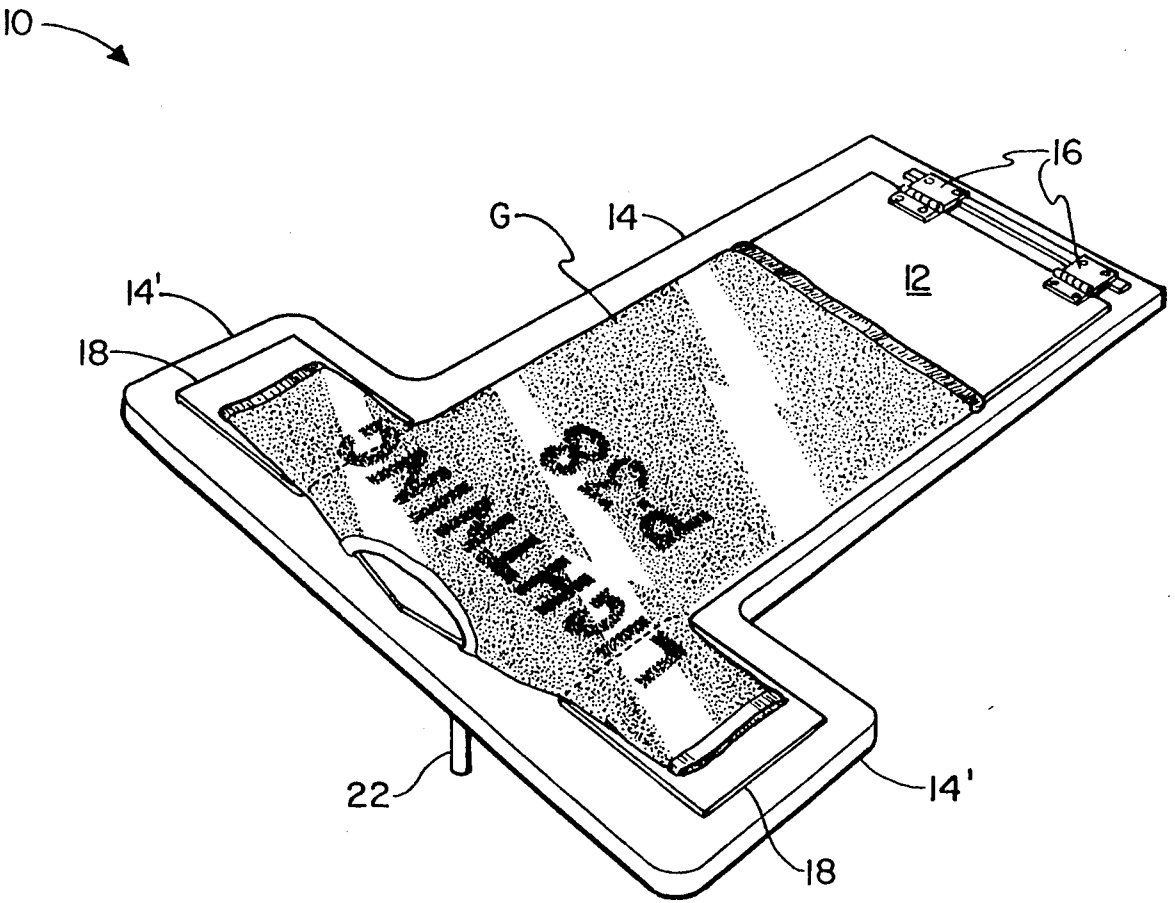
FIG. 6 is a perspective view of a pallet assembly in accordance with the present invention with a T-shirt positioned thereon which has been "over-all" printed.

In use, an operator lifts pallet 12 upwardly to its raised and fixed position with peg 12A resting upon the innermost end of rod 22. A T-shirt or similar garment is positioned on pallet 12, and the operator then pulls the handle of rod 22 outwardly so as to release pallet 12 to fall into contact with pallet support 14. The handle of rod 22 is then released and it is urged inwardly by spring 26 so that the face of the innermost end thereof will abut peg 12A and serve to hold pallet 12 in contact with pallet support 14. The sleeves of garment G positioned on pallet assembly 10 are spread outwardly onto rubber sheets 18 of support arms 14' (see FIG. 6) prior to initiating the multi-station rotary printing process which will result in the "over-all" printing of one side of the garment (including the sleeves thereof). Although many multi-color designs are possible, typically up to eight (8) colors in excellent registration will be printed upon garment G positioned on pallet assembly 10 during processing by the multi-station rotary printing apparatus. After garment G has been fully printed, the operator begins to pull garment G from pallet 12 which serves to more or less automatically raise pallet 12 to its fixed elevated position as shown in FIG. 5. Garment G is pulled off pallet 12 and laid on a conveyor belt of a dryer (not shown) where the ink of the printed image is cured by a heat process. Subsequently, garments G are typically stacked and then returned to the multi-station rotary printing machine (not shown) where each garment G is then placed onto pallet 12 of pallet assembly 10 with the unprinted back side facing up and the entire process repeated again to effect front and back "over-all" multi-color printing of the garment.

Thus, it should be appreciated that with novel pallet assembly 10 "over-all" printing of garments with multiple colors in excellent registration can be effected on a conventional multi-station rotary printing machine which has not heretofore been possible. Also, although the description set forth hereinbefore has been for use of the improved pallet assembly of the invention with a multi-station rotary printing machine, applicant presently contemplates that the pallet assembly could also be used on other types of printing machines and does not intend for the invention to be limited to an improved pallet assembly for use only on multi-station rotary printing machines.

It will be understood that various details of the invention may be changed without departing from the scope of the invention. Furthermore, the foregoing description is for the purpose of illustration only, and not for the purpose of limitation—the invention being defined by the claims.

What is claimed is:

1. A pallet assembly for over-all printing on a multi-station printing machine comprising:

a planar pallet defining a top edge, a bottom edge, and opposing side edges, and adapted for receiving a garment thereon for over-all printing of the entire surface thereof;

a pallet support positioned beneath said planar pallet and defining a top portion adjacent the top edge of said pallet and a bottom portion adjacent the bottom edge of said pallet, said pallet support including laterally outwardly extending support portions on opposing sides adjacent the bottom portion thereof for supporting the sleeves of a garment positioned on said pallet;

hinge means for pivotably mounting said pallet to said pallet support, said hinge means joining the top edge of said pallet to the top portion of said pallet support; and securement means for releaseably securing said pallet against said pallet support during multi-station printing of a garment positioned on said pallet, said securement means comprising an elongate peg depending from the inner surface of said pallet proximate to the top edge thereof, an aperture defined by said pallet support and positioned so that said peg will traverse therethrough when said pallet is positioned against said pallet support, and a resiliently biased slide member positioned on the bottom side of said pallet support and adapted to traverse the bottom of said aperture when said pallet is pivotably raised and to abut said peg extending through said aperture when said pallet lowered into contact with said pallet support.

2. A pallet assembly according to claim 1 wherein said planar pallet comprises an aluminum sheet.

3. A pallet assembly according to claim 1 wherein said pallet support comprises wood.

4. A pallet assembly according to claim 1 wherein a rubber pad is secured to the top surface of each of said outwardly extending support portions of said pallet support so that the top surfaces thereof are substantially co-planar with the top surface of said pallet.

5. A pallet assembly according to claim 1 wherein said hinge means comprises two spaced-apart hinges.

6. A pallet assembly for over-all printing on a multi-station printing machine comprising:

an aluminum planar pallet defining a top edge, a bottom edge, and opposing side edges, and adapted for receiving a garment thereon for over-all printing of the entire surface thereof;

a T-shape wood pallet support positioned beneath said planar pallet and defining a top portion adjacent the top edge of said pallet and a bottom portion adjacent the bottom edge of said pallet, said pallet support including laterally outwardly extending support portions on opposing sides adjacent the bottom portion thereof for supporting the sleeves of a garment positioned on said pallet and a rubber pad affixed to the top surface of each of said outwardly extending support portions of said pallet support so that the top surfaces thereof are substantially coplanar with the top surface of said pallet in order to provide a substantially flat surface for over-all printing of an entire garment;

at least one hinge for pivotably mounting said pallet to said pallet support, said hinge joining the top edge of said pallet to the top portion of said pallet support; and securement means for releaseably securing said pallet against said pallet support during multi-station printing of a garment positioned on said pallet, said securement means comprising an elongate peg depending from the inner surface of said pallet proximate to the top edge thereof, an aperture defined by said pallet support and positioned so that said peg will traverse therethrough when said pallet is positioned against said pallet support, and a resiliently biased slide member positioned on the bottom side of said pallet support and adapted to traverse the bottom of said aperture when said pallet is pivotably raised and to abut said peg extending through said aperture when said pallet is lowered into contact with said pallet support.

7. A pallet assembly for over-all printing on a multi-station printing machine comprising:

a planar pallet defining a top edge, a bottom edge, and opposing side edges, and adapted for receiving a garment thereon for over-all printing of the entire surface thereof;

a pallet support positioned beneath said planar pallet and defining a top portion adjacent the top edge of said pallet and a bottom portion adjacent the bottom edge of said pallet, said pallet support including laterally outwardly extending support portions on opposing sides for supporting the sleeves of a garment positioned on said pallet;

hinge means for pivotally mounting said pallet to said pallet support, said hinge means joining the top edge of said pallet to the top portion of said pallet support; and securement means for releaseably securing said pallet against said pallet support during multi-station printing of a garment positioned on said pallet, wherein said securement means comprises an elongate peg depending from the inner surface of said pallet proximate to the top edge thereof, an aperture defined by said pallet support and positioned so that said peg will traverse therethrough when said pallet is positioned against said pallet support, and a resiliently biased slide member positioned on the bottom side of said pallet support and adapted to traverse the bottom of said aperture when said pallet is pivotably raised and to abut said peg extending through said aperture when said pallet is lowered into contact with said pallet support.

* * * * *